United States Patent [19]

Sato

[11] 4,076,881

[45] Feb. 28, 1978

[54] INTERLINING STRUCTURE FOR APPAREL AND METHOD FOR ITS PRODUCTION

[75] Inventor: Koichi Sato, Tokyo, Japan

[73] Assignee: Sanyo Shokai Ltd., Tokyo, Japan

[21] Appl. No.: 609,730

[22] Filed: Sep. 2, 1975

[51] Int. Cl.[2] ..... B05D 1/36; B05D 5/10; B32B 3/16

[52] U.S. Cl. ..... 428/195; 2/82; 2/87; 427/207 A; 427/210; 428/196; 428/198; 428/200

[58] Field of Search ..... 427/209, 210, 207 A, 427/207 C, 291, 288; 428/195, 196, 198, 200; 2/143, 87, 82, DIG. 5

[56] References Cited

U.S. PATENT DOCUMENTS

| | | | |
|---|---|---|---|
| 2,294,347 | 8/1942 | Bauer et al. | 428/198 |
| 2,735,791 | 2/1956 | Peyrot et al. | 428/266 |
| 3,563,842 | 2/1971 | Thomas | 2/87 |
| 3,922,418 | 11/1975 | Lauchenauer | 428/196 |

FOREIGN PATENT DOCUMENTS

| | | | |
|---|---|---|---|
| 1,197,767 | 7/1970 | United Kingdom | 428/195 |

*Primary Examiner*—J.C. Cannon

*Attorney, Agent, or Firm*—Wenderoth, Lind & Ponack

[57] ABSTRACT

An apparel interlining structure having a plurality of areas, on one surface of an interlining base, to which a hot-melt sealant synthetic resin has been applied, the interlining base being impregnated entirely, except for at least a part of the surfaces of the sealant-applied areas, with a water-repellent composition having poor co-meltability with the above synthetic resin, and a method for its production.

5 Claims, 3 Drawing Figures

INTERLINING STRUCTURE FOR APPAREL AND METHOD FOR ITS PRODUCTION

This invention relates to an interlining structure of apparel, and especially a structure suitable as an interliner for various kinds of apparel using waterproofed outer fabrics, such as raincoats and sportswear for mountaineering, skiing, fishing and golfing (they will be generically referreed to hereinbelow as rainwear), and to a method for its production.

BACKGROUND OF THE INVENTION

The present invention is an improved interlining structure which is free from the defects of conventional interlining structures for waterproofed apparel such as a dot-type interlining structure obtained by applyinng a hot-melt sealant resin partly to one surface of an interliner base, and to a method for producing it. Especially, it relates to an interlining structure which has been markedly improved in water absorption, water permeability, and the state of wetting of outer fabrics, and to a method for its production. Furthermore, it relates to an interliner structure of improved effects which has eliminated various other defects such as the irregular protruding portions of the surface of an outer fabric or the incomplete adhesion between the outer fabric and the interlining structure, and to a method for its production.

Apparel interlining structures in which a hot-melt sealant synthetic resin has been applied partly to one surface of an interliner base have already been known, and for example, dot-type interliner structures have come into practical use.

Such conventional interlining structures have frequently been used, for example, at the collar, shoulder, front, or pocket of a garment. In use, such as interlining structure is superimposed on an outer fabric of the garment with the hot-melt sealent applied surface being placed face to face with the outer fabric, and the assembly is heated under pressure to bond the interliner to the outer fabric. For example, at the collar portion, it is common practice to fold such a bonded structure with the interliner structure being situated inwards, and then subject it to a heat-pressing treatment by, for example, ironing to make it into the shape of a collar.

We noticed that when such a conventional interlining structure is used, irregular protruding portions occur on the surface of an outer fabric, for example, during wearing in the rain. When such a phenomonon occurs immediately after the making of a collar portion, etc. of a garment, it results in the disadvantage of reducing the commercial value of the garment. In addition, we found that this undesirable phenomenon frequently becomes very conspicuous upon repeated washing and wearing or repeated wetting with rain and drying.

In the case of waterproofed apparel such as raincoats, the wearer often experiences considerable wetting as those portions which use the interlining structure, such as the collar or front.

We have investigated into the defect of irregular protruding of the surface of an outer fabric at those portions in which the interlining structure is used, and the defect of reduced waterproofness of the waterproofed outer fabric. The investigation led to the following discoveries.

When the outer fabric and the interlining structure are heat-pressed, a part of the hot-melt sealant resin permeates into the outer fabric to serve for the bonding of the two, and another part of it also permeates into the interliner base. The manner of permeation, however, differs from the interstices among the fibers in the base or the portion of sparsely assembled fibers to the other densely assembled fibers. In the above-mentioned interstices or the sparsely assembled portion, the hot-melt sealant resin is liable to bleed out onto the back surface where the resin is not applied, and has difficulty of permeating into the other portions. When such a bonded structure is folded with the interlining structure being situated inwards and heat-pressed, the superimposed back surfaces adhere to each other irregularly and partly. This is the cause of the formation of irregular protruding parts on the outer fabric. In order to avoid this phenomenon, measures may be taken to adhere the back surfaces to each other uniformly throughout. However, this requires the use of an interliner base having a markedly restricted texture, and a complex and difficult sewing operation is required. Even if such a restricted special base is used or the disadvantageous sewing operation is performed, it is still necessary to increase the amount of the hot-melt sealant resin. Furthermore, this frequently results in the permeation of the sealant resin into the surface of the outer fabric. With a view to avoiding the above phenomenon, we also attempted to prevent the back surfaces from adhering to each other, but this procedure is restricted by many factors such as the amount of the hot-melt sealant resin to be used and the control of the permeation of the resin into the interliner base, and found to be totally unfeasible.

When, for example, a dot-type interlining structure in which a hot-melt sealent resin has been applied partly to one surface of the interlining base is dipped in a solution of a synthetic resin which has poor co-meltability with the above sealant resin in an attempt to prevent the permeation of the synthetic resin into the back surface of the interlining structure, the bonding of the interliner to the outer fabric is substantially sacrificed. Furthermore, when the interliner base is first dipped in the above solution of the synthetic resin having poor co-meltability and then the hot-melt sealant resin is applied, the sealant-applied areas are liable to drop off, and the products cannot be used for practical purposes.

SUMMARY OF THE INVENTION

As a result of our investigations about the defect of reduced waterproofness, we found that the boundaries of the sealant-adhered areas positively pull raindrops on the outer fabric towards the interlining structure (to be referred to as a water-inducing phenomenon). Consequently, the outer fabric is badly wetted at those portions in which the interlining structure is used, and once this wetting has occurred, rainwater permeates increasingly rapidly.

We furthered our investigations, and found that these defects can completely be remedied by an apparel interlining structure of a very simple structure which has a plurality of areas, on one surface of an interlining base, to which a hot-melt sealant synthetic resin has been applied, the interlining base being impregnated entirely, except for at least a part of the surfaces of the sealant-applied areas, with a water-repellent composition having poor co-meltability with the above synthetic resin.

We have also found that such an interlining structure can be produced easily by a simple process which comprises applying a hot-melt sealant synthetic resin partly to one surface of an interlining base for apparel to form a plurality of areas to which the hot-melt sealant resin has been adhered, and applying a solution of a water-repellent composition resin having poor co-meltability with the above sealant synthetic resin to that surface of the base which is opposite to the sealant-applied surface by suitable means such as spraying or coating thereby to impregnate the base entirely except for at least a part of the surfaces of the sealant-applied areas, with the water-repellent composition.

It is an object of this invention therefore to provide an improved interlining structure which is free from the defects of the conventional interlining structures having a plurality of areas on one surface of an interlining base to which a hot-melt sealant synthetic resin has been applied and is especially suitable for use in waterproofed apparel such as raincoats.

Another object of this invention is to provide a method for producing the above-mentioned improved interlining structure.

BRIEF DESCRIPTION OF THE DRAWINGS

The above and other objects and advantages of this invention will become more apparent from the following description taken in conjunction with the accompanying drawings in which:

FIG. 2' is a more enlarged sectional view of a part of the structure shown in FIG. 2.

DETAILED DESCRIPTION OF THE INVENTION

Figure 1:
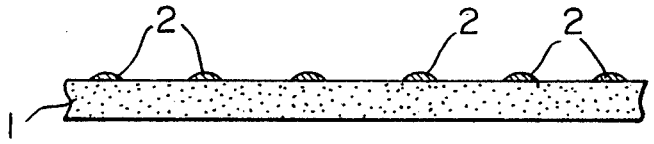
FIG. 1 is an enlarged sectional view of a part of one example of the conventional dot-type interlining structure in which a plurality of areas 2 having applied thereto a hot-melt sealant composition are present on one surface of an interlining base 1.
Figure 2:
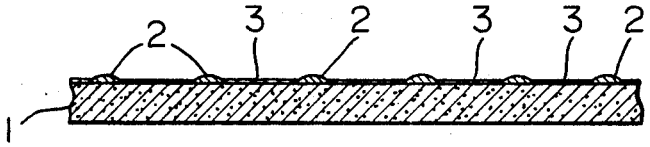
FIG. 2 is an enlarged sectional view of a part of one example of the interlining structure of this invention which is of a similar dot-type structure but in which the entire interlining base except a part of the surfaces of the sealant-applied areas 2 is impregnated with a water-repellent synthetic resin 3 having poor co-meltability with the above synthetic resin.
Figure 2:
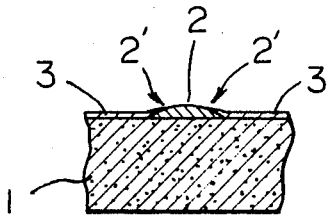

As shown in FIG. 2', the water-repellent composition 3 in the interlining structure of this invention may permeate into the base 1 having the sealant areas 2 on its surface. In the embodiment shown in FIG. 2', the composition 3 extends to the sides of the boundaries of the areas 2 leaving the surface portions between 2' and 2' in FIG. 2' uncovered with the composition. It is only sufficient that the composition 3 extends to near the surface of the interlining base, and it is not altogether necessary to cause it to extend to the sides of the boundaries of the areas 2. In this manner, the entire interlining base is impregnated with the water-repellent composition 3, excepting only a part of the surfaces of the resin-applied areas 2. If the composition 3 is applied to cover all the surfaces of the resin-applied areas 2, the resulting interlining structure adheres insufficiently to an outer fabric or easily peels from the adhered portion on the outer fabric. Furthermore, when the composition 3 does not reach the surface of the interlining base but, for example, is impregnated only in the surface layer of the back surface, the water-inducing phenomenon described hereinabove cannot be avoided.

The above description has been directed to the so-called dot-type interlining structure having a plurality of the sealant-applied small areas 2 present in the form of dots on one surface of the interlining base. But the shape and size of resin-applied areas 2 to be formed partly on one surface of the base can be optionally changed or modified. For example, these areas can be in the form of straight-line stripes, wavy stripes, or annular patterns. The type of the interlining base is not restricted byt may be knitted, woven or non-woven fabrics of various natural, regenerated, and synthetic fibrous materials. Of these, the knitted or woven fabrics are especially preferred. That surface of the base cloth which is opposite to the resin-applied surfaces may be napped.

The hot-melt sealant synthetic resins used to form the resin-applied areas 2 are well known, and for example, adhesive polymers or copolymers of the polyamide, polyvinyl and polyolefin types, or blends of these polymers can be utilized. Of these, the polyamide-type adhesive synthetic resins are preferred. Examples of suitable hot-melt sealant resins used in this invention are the polyamide-type adhesive synthetic resin derived from laurolactam and caprolactam as disclosed in U.S. Pat. No. 3,410,832 and the polyamide-type adhesive synthetic resin derived from laurolactam and another polyamide-forming compound selected from the group consisting of caprolactam, hexamethylenediamine adipate and hexamethylenediamine sebacate as disclosed in Japanese Patent Publication No. 22240/70 (German Patent Application No. P38767). Polyolefin-type adhesive synthetic resins such as an ethylene/vinyl acetate copolymer and vinyl chloride-type resins can also be utilized in this invention.

The water-repellent composition 3 used in producing the interlining structure of this invention has poor co-meltibility with the hot-melt sealant synthetic resins. The poor co-meltability, as used herein, means that in the molten state, both of these materials are difficult to mix uniformly. Compositions having good co-meltability are undesirable since they are liable to bleed onto the surface of an outer fabric and/or a lining material. These water-repellent compositions are well known per se, and examples of suitable compositions include fluorine-type water-repellents, organosilicon-type water-repellent synthetic resins, Quilone-type water-repellents, triazine-type water-repellent resins, higher fatty acid-nonpyridinium-type water-repellents and higher fatty acid-pyridinium-type water-repellents.

Examples of the higher fatty acid-pyridinium-type compositions are those derived from fatty acid derivatives containing 14 to 20 carbon atoms and pyridinium salts, or from carbamates and urea compounds. Preferably, they are resins expressed by the following formula

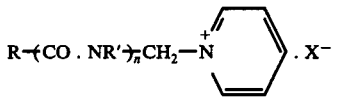

wherein R is an akyl or alkoxy group containing 14 to 20 carbon atoms, R' is a hydrogen atom or an alkyl group containing 1 to 4 carbon atoms, $n$ is 0, 1 or 2 and $X^-$ is an anion such as $Cl^-$, $COOH^-$, $CH_2OO^-$,

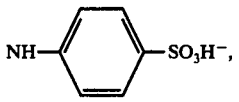

or $SCN^-$,
available commercially under trademarks Zelan (a product of E. I. du Pont de Nemours & Co.), or Velan (a product of Imperial Chemical Industries).

The higher fatty acid-nonpyridinium-type water-repellents may have the following formula $$RCONR' - CH_2OR''$$

wherein R and R' are the same as defined above, and R'' is, for example, a hydrogen atom, a hydroxyalkyl group containing 1 to 4 carbon atoms, an alkylcarboxyl group containing 1 or 2 carbon atoms, $-C_2H_4SO_3H$, or

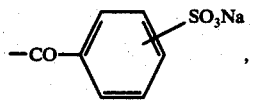

available commercially under tradename KAHRAN WA (a product of Meisei Chemical CO., Ltd.).

Preferably, the triazine-type water-repellent synthetic resins are melamine amide-type resins, for example, resins derived from compositions of the following formula

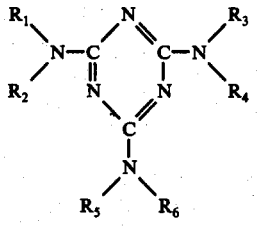

wherein $R_1$ to $R_6$ each represent hydrogen, $-CH_2OR'''$ in which R''' is a group selected from the class consisting of alkyl groups containing 1 to 20 carbon atoms, $-CH(CH_2OR)_2$, R being the same as defined above, and $-CH_2NR'.CO.R$, R and R' being the same as defined above, and $-CH_2NR'.CO.R$ in which R and R' are the same as defined above.

Specific examples are

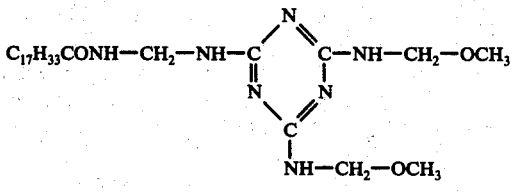

and

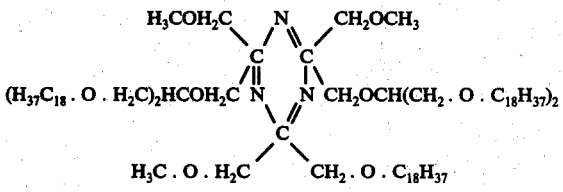

Examples of the Quilone-type water-repellents are higher fatty acid chromic chlorides of the following formula

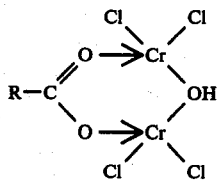

wherein R is the same as defined above.

Examples of the organosilicon-type water-repellent synthetic resins are mono- or di-lower alkyl polysiloxanes, such as a methylchlorosilane resin or dimethylchlorosilane resin.

Examples of the fluorine-type water-repellent compositions are perfluorocarboxylic acids (e.g., a Cr-complex of perfluorooctanoic acid) of the following formula

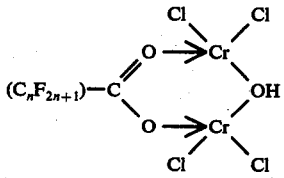

wherein *n* is a number from 4 to 12, poly(dihydroperfluorocarbonyl acrylate) (e.g., poly(1,1-dihydroperfluorooctyl acrylate), expresseed by the following formula

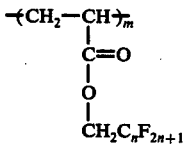

wherein *n* is the same as defined above and *m* is the molecular weight of the main chain, $CH_2{=}CH{-}O{-}CH_2{-}C_nF_{2n}{-}CF_3$ wherein *n* is the same as defined above, and

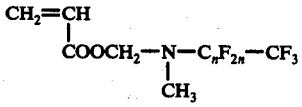

wherein *n* is the same as defined above.

In the preparation of the interlining structure of this invention, these water-repellent compositions can be used as solvent solutions by diluting them with a chlorinated hydrocarbon solvent such as perchloroethylene or trichloroethylene, or a petroleum hydrocarbon solvent such as mineral terpene. They can be used also as emulsions.

In the production of the interlining structure of this invention, a hot-melt sealant synthetic resin is applied partially to one surface of an interliner base 1 to form a plurality of sealant-applied areas 2 of the desired shape and size. Then, a solution or emulsion of the above water-repellent composition is applied to that surface of the base which is opposite to the sealant-applied surface by suitable means such as spraying or coating and is then heat-dried to form the final product.

In this process, at least a part of the surfaces of the resin-applied areas 2 (for example, at least 30%, preferably at least 50%, of the surfaces) must be caused to remain non-impregnated with the water-repellent composition, and care should be taken not to cover the surfaces of the resin-applied areas completely with the water-repellent composition. Such an interlining structure would markedly reduce its adhesion to the outer fabric and would fail to achieve the object of hot-melt sealing. When the water-repellent composition is first applied to the interlining base 1 and the sealant resin-applied areas formed thereafter, the sealant-applied areas are liable to peel and drop off, and when it is bonded to an outer fabric by hot-melt sealing, the interliner is liable to separate from the outer fabric.

The following Examples and Comparative Examples illustrate the present invention in greater detail. In the following examples, the water absorption, water permeability and surface condition with regard to waterproofness and the adhesion of the interlining structure to an outer fabric were tested by the following methods.

I. Waterproofness test

1. Water absorption (%)

Measured in accordance with DIN 53888 based on the Bundesmann's test (tester: Type BP-2). The amount of rainfall used for the test was 800 cc per 10 minutes. Smaller values show better waterproofness.

2. Water permeability (cc)

Measured in accordance with DIN 53888 based on the Bundesmann's test (tester: Type BP-2). Smaller values show better waterproofness.

3. Wet condition of the surface

Measured in accordance with DIN 53888 based on the Bundesmann's test. The evaluation was made on a scale of the following six grades ++, +, +−, −+, −, in which ++ is the best and − is the worst.

II. Washing durability test

Measured in accordance with a washing test in JIS L-1042. After the test, the samples were dried, and evaluated by a panel of specialists on the following items.

1. Surface roughness

The roughness of the surface of the outer fabric was observed visually, and evaluated on a scale of the following three grades.

| Grade | Condition |
|---|---|
| A | No appreciable change, and the surface condition before the washing test was maintained |
| B | Surface roughness occurred in the form of raised and depressed portions |
| C | Considerable occurrence of surface roughness in the form of raised and depressed portions |

2. Puckering

The occurrence of creases in the seam portion of the outer fabric was observed visually, and evaluated on a scale of the following three grades.

| Grade | Condition |
|---|---|
| A | No appreciable occurrence of creases, and the condition before the test was maintained |
| B | Creases occurred |
| C | Considerable occurrence of creases |

3. Straining of the boundary

Straining that appeared on the outer fabric in an area along the boundary line of the hot-melt sealant-applied portion of the interliner and that portion of the outer fabric in which no interliner was present was observed visually, and evaluated on a scale of the following three grades.

| Grade | Condition |
|---|---|
| A | No appreciable change in the boundary portion, and the condition before the test was maintained |
| B | Straining occurred in the boundary portion |
| C | Considerable straining occurred in the boundary portion |

EXAMPLE 1 AND COMPARATIVE EXAMPLES 1 AND 2

One surface of a plain-weave cotton cloth containing 68 warps and 63 wefts (both being single yarns of 40 count) per square inch was napped by emery. A polyamide-type hot-melt sealant resin (a copolyamide resin derived mainly from laurolactam, caprolactam and hexamethylenediamine adipate) was applied in the form of dots to the unnapped surface of the cloth. A silicone-type water-repellent synthetic resin (SILICONE KS730, trademark for a methyl polysiloxane resin composed mainly of methylhydrogen polysiloxane molecules) as a solution in a chlorinated hydrocarbon solvent was applied by spraying to the napped surface of the cloth to such an extent that the water-repellent resin bled out onto that surface of the base cloth to which the polyamide-type hot-melt sealant resin had been applied, but did not completely cover the sealant resin. The coated cloth was dried to remove the solvent, and an interlining structure in accordance with this invention was thus obtained (Example 1).

For comparison, another interlining structure was prepared in the same way as above except that the silicone-type water-repellent synthetic resin was applied so as not to bleed out onto the sealant resin-applied surface of the base cloth but to allow it to permeate to near that surface (Comparative Example 1). Furthermore, an interlining structure was prepared in the same way as Example 1 above except that the treatment with the water-repellent synthetic resin was omitted (Comparative Example 2).

EAch of the interlining structures obtained in Example 1 and Comparative Examples 1 and 2 was cut to a size of 20 cm in length and 30 cm in width, and placed at the center of the back surface of an outer fabric with a length of 30 cm and a width of 40 cm (a raincoat material obtained by waterproof treatment of a polyester plain-weave fabric containing 156 warps and 70 wefts, both being yarns of 85 count, per square inch). Each of the interlining structures was bonded to the raincoat outer fabric by hot-melt sealing under the same conditions. For the washing test, a rectangular (15 cm long and 20 cm wide) seam was provided at the central part of each of the samples by a sewing machine.

The resulting samples were tested for the waterproofness (I) and the waterproofness durability (II). The results are shown in Table 1.

Table 1

| | Tests | Control (*) | Example 1 | Comparative Example 1 | Comparative Example 2 |
|---|---|---|---|---|---|
| (I) | Water absorption (%) | 0 | 22.1 | 71.3 | 99.2 |

Table 1-continued

| | Tests | Control (*) | Example 1 | Comparative Example 1 | Comparative Example 2 |
|---|---|---|---|---|---|
| Water- | Water permeability (cc) | 0 | 0.3 | 7.4 | 10.6 |
| proofness | Surface condition | ++ | + | +− | +− |
| (II) | Surface roughness | − | A | B | B |
| Washing | Puckering | − | A | C | C |
| durability | Straining at the boundary | − | A | A | B |

(*) Data about the outer fabric alone.

The above results demonstrate that the use of the interlining structure of this invention not only ensures superior waterproofness, but also brings about an outstanding waterproofness durability (effects exerted on the outer fabric) which cannot be anticipated from the treatment of the interlining structure with the water-repellent agent.

EXAMPLE 2

Example 1 was repeated using varying kinds of the hot-melt sealant synthetic resin and the water-repellent. The results of the waterproofness test are shown in Table 2 below.

Table 2

| Hot-melt sealant resin | Water-repellent | Bundesmanns's test: Water absorption (%) | Water permeability (cc) | Surface condition |
|---|---|---|---|---|
| Polyamide derived mainly from laurolactam and caprolactam | Zelan | 23.0 | 0.5 | + |
| Polyamide derived mainly from laurolactam and hexamethylenediamine adipate) | Melamine-amide type water-repellent resin | 22.6 | 0.3 | + |
| Polyolefin-type resin derived mainly from ethylene and vinyl acetate | Velan | 22.3 | 0.4 | + |
| Resin derived mainly from vinyl chloride | Poly(dihydroperfluorooctyl acrylate | 23.2 | 0.4 | + |
| Polyamide derived mainly from laurolactam, caprolactam and hexamethylenediamine adipate | Cr-complex of perfluoroctanoic acid | 22.4 | 0.3 | + |

What we claim is:

1. An apparel interlining structure comprising:

an interlining base;

a plurality of raised areas of hot-melt sealant synthetic resin applied to one surface of said interlining base; and a water-repellent synthetic resin entirely, except for at least a part of the surfaces of the sealant-applied areas, impregnating said interlining base, said water-repellant synthetic resin having a poor co-meltability with said hot-melt sealant synthetic resin.

2. An interlining as claimed in claim 1 wherein said water-repellent composition is selected from the group consisting of:

fluorine-type water repellents selected from the group consisting of: perfluorocarboxylic acid, Cr-complex thereof, poly (dihydroperfluorocarbonyl acrylate), $CH_2 = CH - O - CH_2 - C_nF_{2n} - CF_3$ in which $n$ is a number from 4 to 12 and

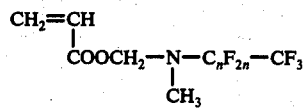

in which $n$ is a number from 4 to 12;

organosilicon-type water-repellent synthetic resins selected from the group consisting of: mono- or di-lower alkyl polysiloxanes;

Quilone-type water repellents of the following formula:

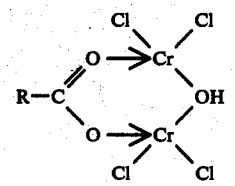

wherein R is an alkyl or alkoxy group containing 14 - 20 carbon atoms;

melamine amide-type resins derived from compounds of the formula

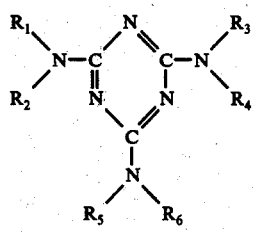

wherein $R_1$ to $R_6$ each represent a member selected from the group consisting of a hydrogen atom, $-CH_2OR'''$ is a group selected from the class consisting of alkyl groups containing 1 to 20 carbon atoms, —CH(CH$_2$OR)$_2$ in which R is an alkyl or alkoxy group containing 14 - 20 carbon atoms, and —CH$_2$NR'.CO.R in which R is the same as defined above and R' is a hydrogen atom or an alkyl group containing 1 to 4 carbon atoms;

higher fatty acid-nonpyridinium-type water repellents of the following formula:

$$RCONR' - CH_2OR''$$

wherein R and R' are the same as defined above, and R'' is a member selected from the group consisting of a hydrogen atom, hydroxyl alkyl group containing 1 to 4 carbon atoms, alkylcarboxyl group containing 1 to 2 carbon atoms, —C$_2$H$_4$SO$_3$H and

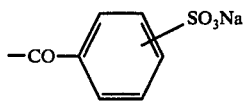

and higher fatty acid-pyridinium-type water repellents of the following formula:

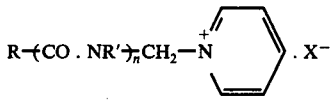

wherein R is an alkyl or alkoxy group containing 14 to 20 carbon atoms, R' is a hydrogen atom or an alkyl group containing 1 to 4 carbon atoms, *n* is 0, 1 or 2 and X$^-$ is an anion.

3. An interlining structure as claimed in claim 1, wherein the hot-melt sealant synthetic resin is selected from the group consisting of:

polyamide hot-melt sealing synthetic resins derived from laurolactam and a polyamide-forming compound selected from the group consisting of caprolactam, hexamethylenediamine adipate and hexamethylenediamine sebacate;

hot-melt sealing synthetic resins of the ethylene/vinyl acetate copolymer; and vinyl chloride hot-melt sealing synthetic resins.

4. Waterproof wearing apparel comprising:

a waterproofed fabric, and an interlining structure at least partially hot-melt sealed to said water-proofed fabric, said interlining structure comprised of:

an interlining base, a plurality of raised areas of hot-melt sealant synthetic resin applied to one surface of said interlining base, and a water-repellant composition resin entirely, except for at least a part of the surfaces of the sealant-applied areas, impregnating said interling base, said water-repellant composition resin having a poor co-meltability with said hot-melt sealant synthetic resin.

5. A process for preparing an apparel interlining structure, which comprises applying a hot-melt sealant synthetic resin partly to one surface of an interlining base for apparel to form a plurality of areas to which the hot-melt sealant resin has been adhered, and applying a solution of a water-repellent composition resin having poor co-meltability with the above sealant synthetic resin to that surface of the base which is opposite to the sealant-applied surface thereby to impregnate the base entirely, except for at least a part of the surfaces of the sealant-applied areas, with the water-repellent synthetic resin areas.

* * * * *